United States Patent [19]

Grenell

[11] 4,342,493

[45] Aug. 3, 1982

[54] WEATHER-RESISTANT ARRANGEMENT FOR OUTDOOR ELECTRICAL DEVICES

[75] Inventor: David Grenell, Laurelton, N.Y.

[73] Assignee: Allen-Stevens Corp., New York, N.Y.

[21] Appl. No.: 198,811

[22] Filed: Oct. 20, 1980

Related U.S. Application Data

[63] Continuation-in-part of Ser. No. 970,866, Dec. 18, 1978, abandoned.

[51] Int. Cl.[3] ..... H01R 13/46

[52] U.S. Cl. ..... 339/44 M

[58] Field of Search ..... 339/37, 43, 44, 123; 174/66, 67; 220/241, 242

[56] References Cited

U.S. PATENT DOCUMENTS

| | | | |
|---|---|---|---|
| 1,630,401 | 5/1927 | Meyer | 339/44 R |
| 2,304,870 | 12/1942 | Yost | 339/44 R |
| 3,140,344 | 7/1964 | Slater et al. | 174/67 |
| 3,189,212 | 6/1965 | Bellek | 174/67 |
| 3,252,611 | 5/1966 | Weitzman et al. | 220/242 |

*Primary Examiner*—Joseph H. McGlynn

*Attorney, Agent, or Firm*—Kirschstein, Kirschstein, Ottinger & Cobrin

[57] ABSTRACT

Electrical devices of outdoor electrical receptacles are protected from weather conditions. A protective cover and a waterproofing gasket are pivotally mounted on a plate for movement along a circular path between a fully closed position, in which the gasket prevents water from reaching the device, and a fully open position, in which access to the electrical device is permitted. A leaf spring having a planar movable portion constantly and affirmatively urges the cover to the closed position. In order to ensure a reliable and automatic return of the cover to the closed position, an anti-over-the-center stop prevents a leading end of the cover, which engages the planar spring portion at a contact zone, from moving the latter beyond an imaginary line which extends from the center of curvature of the circular path in a radial direction towards, and at a right angle to, the plane of the spring portion. The cover is easily mounted by snap-type action to the plate under spring tension.

14 Claims, 12 Drawing Figures

10
12
14
16
18
20
22
24a
24b
24c
24d
26
30
32
34
36
38
40
42
44
46
48
50
52
54
56
58
62
64
66
70
72
80
A
B
2
3

10'
30'
22'
26'
24d'
54'
56'
86'
64'
94'
90'
66'
67'
B'
44'
34'
36'
38'
40'
42'
A'
50'
46'
20'
24a'
26'
12'
18'
24b'
14'
16'
24c'
32'
52'
48'
64'
7
8
9
10

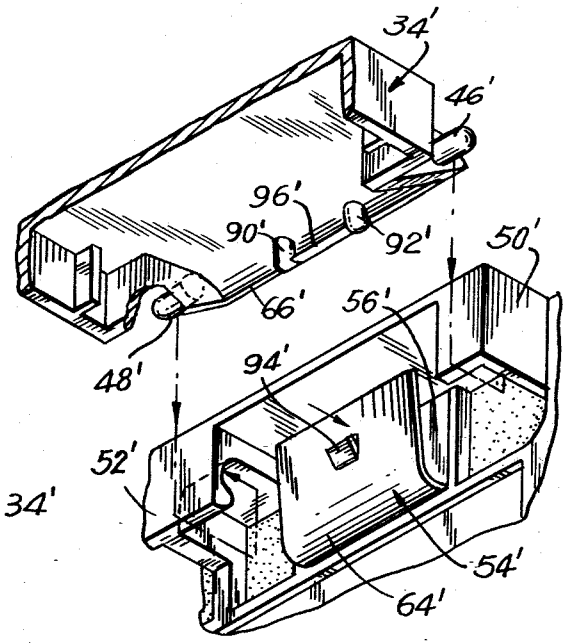
FIG. 12
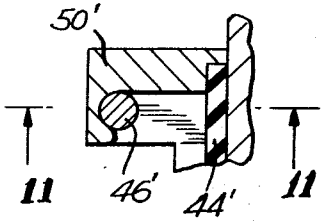
FIG. 10
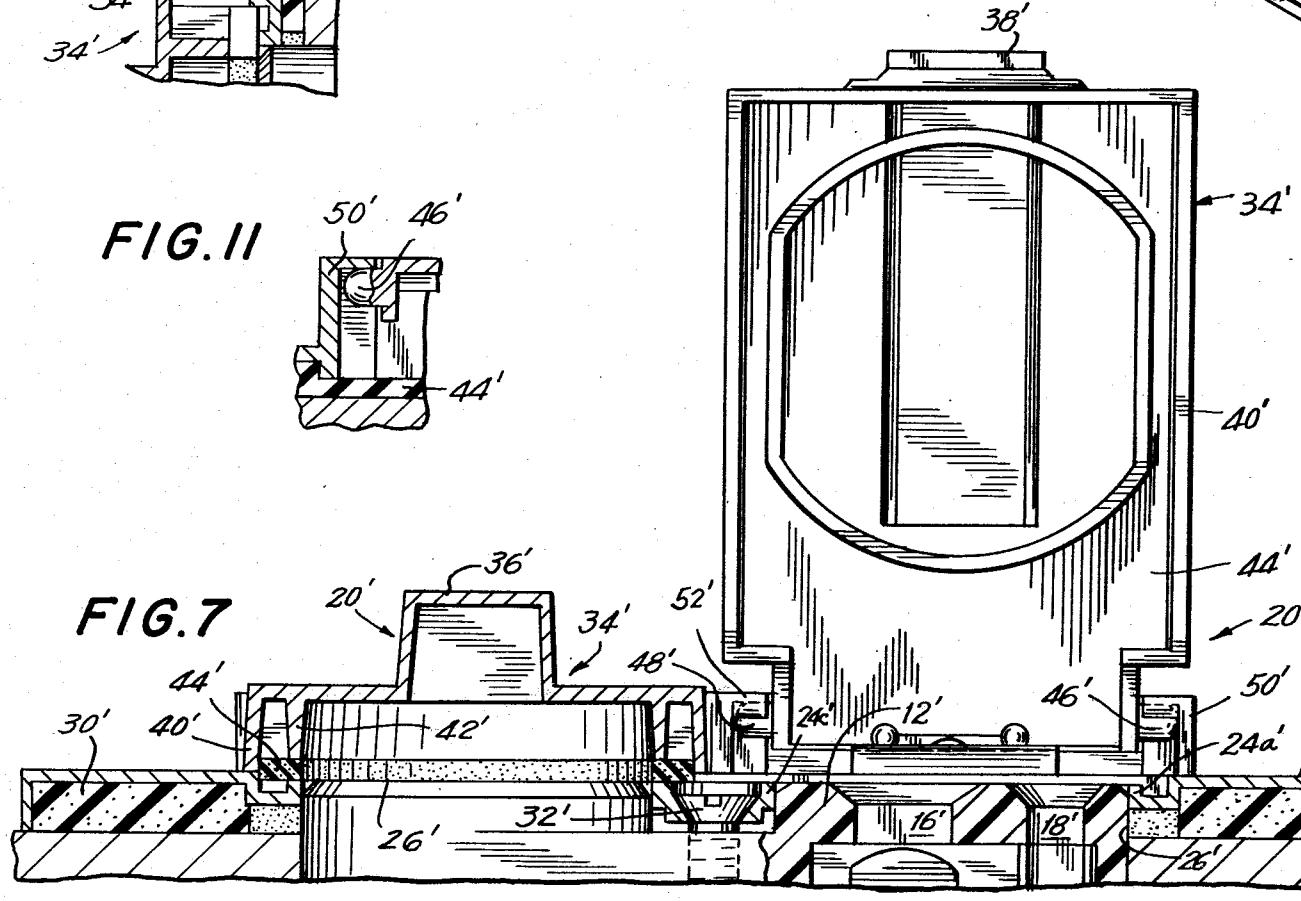
FIG. 7
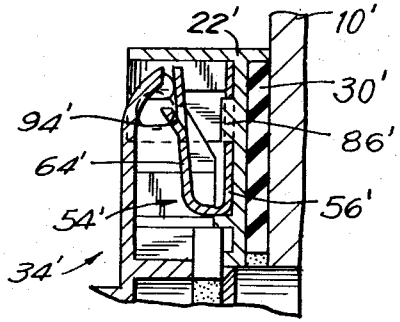
FIG. 9
FIG. 11

WEATHER-RESISTANT ARRANGEMENT FOR OUTDOOR ELECTRICAL DEVICES

BACKGROUND OF THE INVENTION

CROSS REFERENCE TO RELATED APPLICATIONS

This application is a continuation-in-part of my earlier filed application, U.S. Ser. No. 970,866, filed Dec. 18, 1978, now abandoned.

FIELD OF THE INVENTION

The present invention relates generally to weather-resistant arrangements for protecting an outdoor electrical receptacle having an electrical device from the deleterious effects of weather conditions, such as moisture, rain, snow and like environmental conditions. More particularly, the present invention relates to an improved weather-resistant arrangement in which a protective cover is reliably and automatically urged to a position which overlies and protects devices from weather conditions.

Description of the Prior Art

Weather-resistant arrangements for protecting outdoor electrical outlets are known. For example, some outdoor outlets are covered by hinged doors which must be manually opened to gain access to the outlets and which must be thereupon manually closed to protect outlets from the environment. Although generally satisfactory for their intended purpose, the manually operable doors are not altogether practical in operation because many users forget or deliberately neglect to manually close the doors.

It is also known to employ torsion springs for automatically closing a cover for the electrical outlet. However, such torsion spring constructions do not effectively return the cover to the closed position. Moreover, such torsion spring constructions have either bent-over or pinch-type bearings for journalling the torsion springs. A drawback of such constructions is that the torsion springs tend to pull out and deform such bearings. It is extremely difficult to replace the torsion springs back in their bearings once they have pulled out therefrom.

SUMMARY OF THE INVENTION

Objects of the Invention

Accordingly, it is the general object of the present invention to overcome the aforementioned drawbacks of the prior art.

It is an object of this invention to protect outdoor switches and outlets from the deleterious effects of weather conditions, such as moisture, rain, snow, and like environmental conditions.

Another object of this invention is to reliably and affirmatively and automatically return a protective cover to a closed position which protects electrical devices.

Still another object of this invention is to affirmatively maintain the cover in its closed position by a constantly applied closure force of a predetermined magnitude.

Still a further object of this invention is to prevent a spring for biasing the cover from pulling out of, and doing damage to, its journalled bearings.

It is an object of this invention to prevent undesired lateral shifting of a spring relative to its cover.

Yet another object of this invention is to easily install a protective cover on its plate by a snap-in mounting.

Another object of this invention is to provide an economical and easy to manufacture weather-resistant arrangement for protecting outdoor electrical devices.

Features of the Invention

In keeping with these objects, and others which will become apparent hereinafter, one feature of the invention resides, briefly stated, in a weather-resistant arrangement for protecting an outdoor electrical receptacle having female-type sockets from the deleterious effects of weather conditions such as moisture, rain, snow, and like environmental conditions, which comprises a receptacle plate mounted in sealing engagement with an outdoor support structure on which the receptacle to be protected is supported, which plate has wall portions bounding an opening behind which the sockets are located, and through which mating male-type prongs of an electrical plug are inserted into the sockets to establish electrical connection with the same. The invention further comprises a protective cover pivotally mounted on the plate for turning movement about a turning axis and along a generally circular path between a fully closed position, in which the cover overlies the opening and bars insertion of the prongs into the sockets, and a fully open position, in which the cover extends generally normally of the plane of the opening and permits access to the latter for the prongs.

In addition, the invention comprises water-proofing means mounted on the cover for movement together with the same, which sealingly and water-tightly engages the wall portions of the plate in the closed position to prevent water from reaching the sockets and causing damage.

The invention also comprises means for constantly and affirmatively urging the cover along the path towards the closed position to automatically protect the sockets after the prongs have been removed from the same, which urging means includes biasing means in force-transmitting engagement with the plate and the cover. The biasing means constitutes an energy-storing spring which engages the cover at a mutual contact zone which is movable between a first tensioned position, in which the cover is affirmatively maintained at the closed position with a closure force of a predetermined magnitude, and a second tensioned position, in which the cover is affirmatively urged from the open to the closed position with a closure force of a magnitude greater than the predetermined magnitude. Additionally, the urging means comprises anti-over-the-center stop means in the path for preventing movement of the cover past the fully open position, and for concomitantly preventing the contact zone from being so positioned relative to the spring such that a restoring torque is constantly exerted by the spring on the cover, to thereby reliably and automatically return the cover to the closed position.

Electrical devices other than electrical outlets, such as electrical toggle switches, may also be employed.

Another feature of the invention is embodied in bearings for journalling the protective cover. These bearings are one-piece members which are integrally formed on the receptacle plate. Each bearing has a cutout passage portion through which a respective stub shaft of the cover is easily inserted, and a journal passage portion in which the shaft is urged and journalled under spring tension. In fact, the aforementioned spring which biases the cover is used for the additional purpose of biasing the shafts in the bearings. The snap-in assembly of the cover is extremely easy to perform.

The novel features which are considered as characteristic for the invention are set forth in particular in the appended claims. The invention itself, however, both as to its construction and its method of operation, together with additional objects and advantages thereof, will best be understood from the following description of specific embodiments when read in connection with the accompanying drawings.

BRIEF DESCRIPTION OF THE DRAWINGS

FIG. 7 is a cross-sectional view of the embodiment of FIG. 6 as taken along line 7—7 of FIG. 6;

FIG. 9 is a cross-sectional view as taken along line 9—9 of FIG. 6;

FIG. 10 is a cross-sectional view as taken along line 10—10 of FIG. 6;

FIG. 11 is a sectional view as taken along line 11—11 of FIG. 10; and FIG. 12 is a partially broken-away, enlarged perspective view of a detail of FIG. 9.

DETAILED DESCRIPTION OF THE PREFERRED EMBODIMENTS

Figures 1, 3:
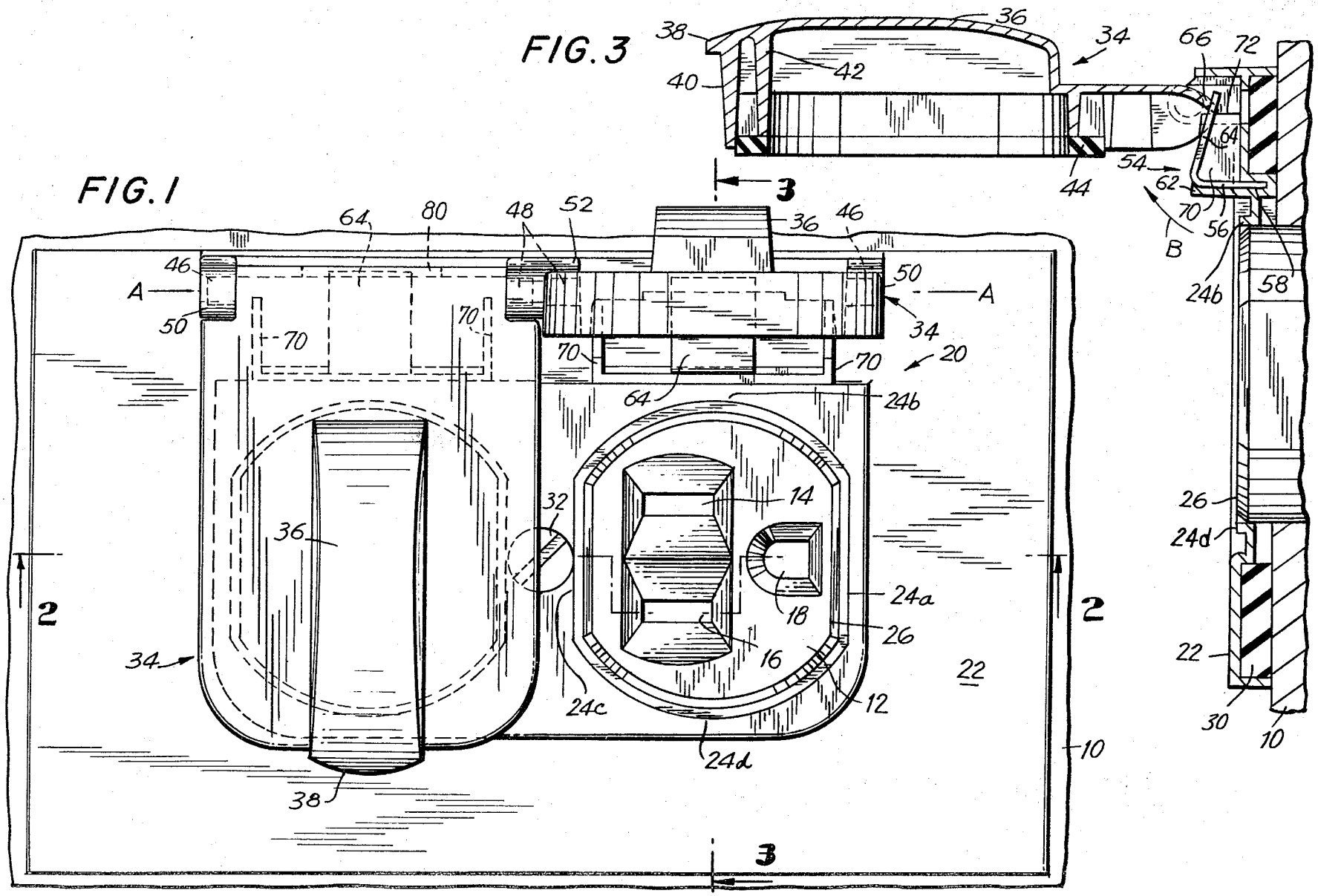
FIG. 1 is a top plan view of a weather-resistant arrangement in accordance with one embodiment of the present invention.
FIG. 3 is a cross-sectional view as taken along line 3—3 of FIG. 1.
Figure 5:
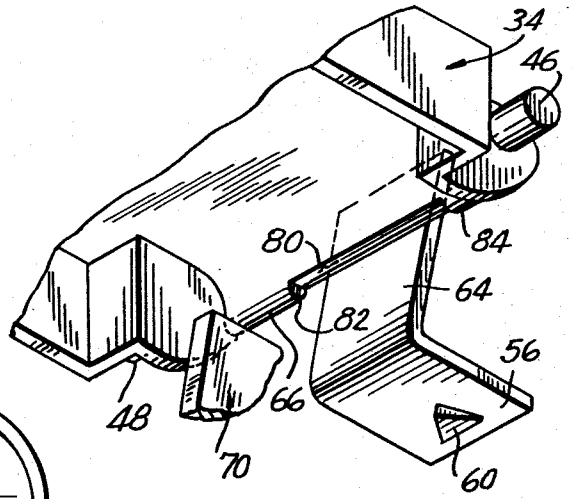
FIG. 5 is a partially broken away, enlarged perspective view of a detail of FIG. 4.
Figure 2:
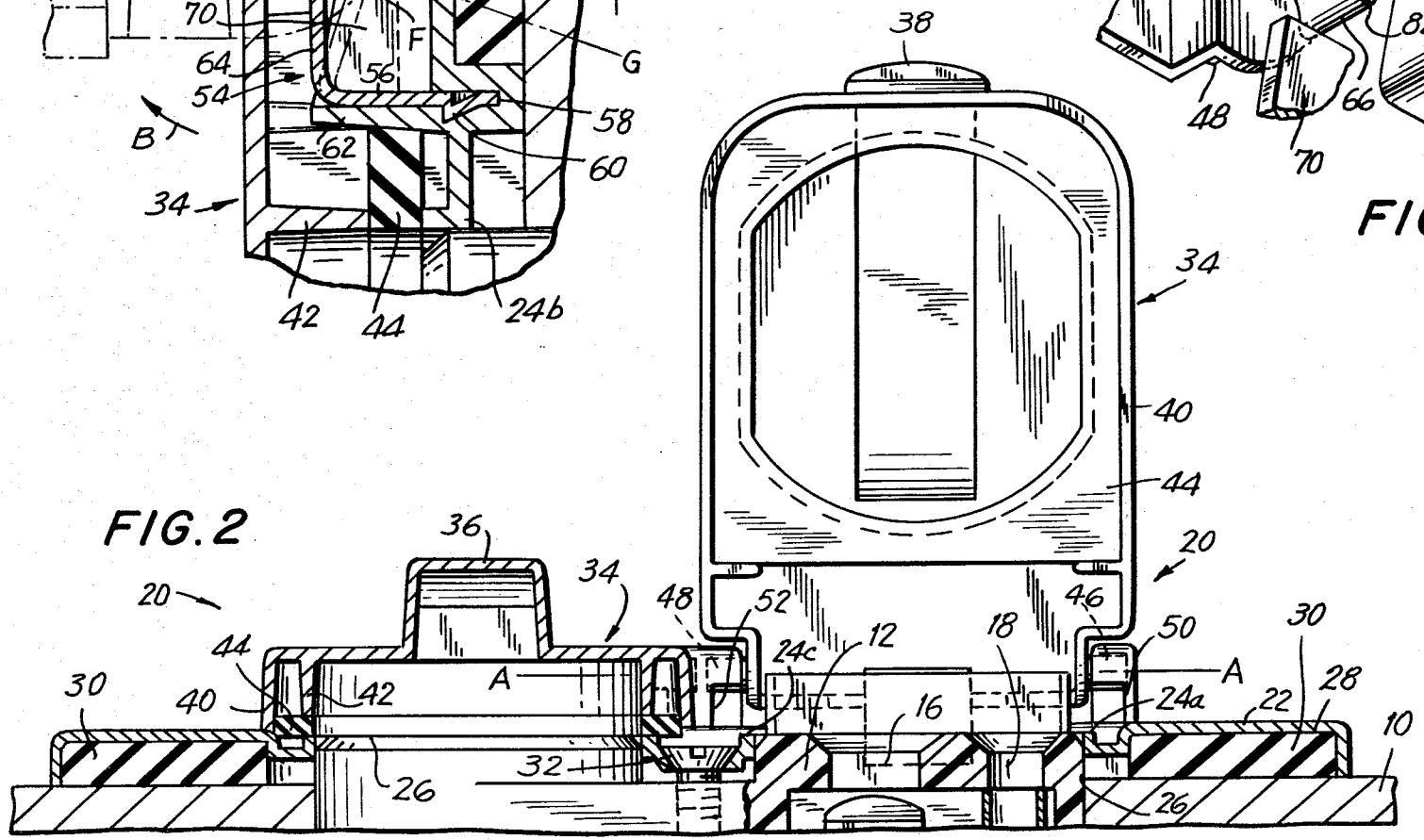
FIG. 2 is a cross-sectional view of the embodiment of FIG. 1 as taken along line 2—2 of FIG. 1.

Referring now to FIGS. 1 and 2 of the drawings, reference numeral 10 generally identifies an outdoor support structure such as a siding wall or an electrical junction box mounted on the same. An electrical receptacle having multiple outlets is supported by the outdoor structure 10. Each electrical outlet 12 is conventionally provided with female-type power sockets 14, 16 and a ground socket 18 in which nonillustrated conventional male-type power prongs and a ground prong of an electrical plug are respectively inserted for establishing an electro-mechanical connection therewith. The number of sockets and the number of outlets is completely optional. Other electrical devices such as electrical toggle switches could also be mounted on the receptacle.

Although the invention will be primarily described for protecting outlet sockets, it will be expressly understood that this is for ease of description purposes only.

In accordance with the present invention, a weather-resistant arrangement 20 is associated with each outlet and is operative for protecting the electrical sockets from the deleterious effects of weather conditions, such as moisture, rain, sleet, snow, and like environmental conditions. The electrical sockets include metal contacts and it is known that such metallic materials are highly susceptible to rust and corrosion caused by compounds in the air, such as carbon dioxide, which form acidic solutions in the presence of moisture.

To prevent such oxidation, each weather-resistant arrangement 20 includes a generally rectangular receptacle plate 22 of rust-proof material. The plate 22 is preferably a metal coated by a rust-proof zinc oxide coating, but can also be made of synthetic plastic material. At its upper surface, the plate 22 has wall portions *24a, 24b, 24c, 24d,* which together frame and bound at least one opening 26 therein. The sockets 14, 16, 18 are located at the opening 26, and the plug prongs must pass through opening 26 in order to mate with the sockets.

At its underside, the plate 22 has a rectangular recess 28 which surrounds the entire plate periphery. A generally rectangular, planar rubber sealing gasket 30 is freely lodged or adhesively secured in recess 28. The gasket is compressed between the underside of the plate and the upper surface of the outdoor structure 10 to thereby sealingly and water-tightly engage the same.

A mounting aperture 32 is centrally located in the plate and the illustrated mounting screw is received in aperture 32 for fixedly securing the plate to the structure. Different screw locations and different types of mounting arrangements can also be employed.

At least one rust-proof protective cover is mounted on the plate 22 for limited turning angular movement about a turning axis A-A and along a circular path whose downstream direction is designated by the arrow B. Each cover has a generally rectangular parallelepiped-shaped handle portion 36 at its upper outwardly bulging surface and has an overhanging lip 38 which facilitates manual gripping by a user. The interior cavity bounded by the handle portion 36 provides mechanical clearance for the upstanding toggle switch handle in the case where switches rather than outlets are used. At its lower surface, each cover has a downwardly projecting outer rim 40 and an inner concentric rim 42. The height of outer rim 40 is slightly greater than that of inner rim 42. A generally rectangular planar rubber sealing gasket 44 is mounted at, and is preferably adhesively secured to, inner rim 42.

Each cover has stub shafts 46, 48 cast of one piece therewith. The stub shafts are journalled in bearings which are cast of one piece with and are integrally formed with the plate. Thus, outer stub shafts 46, 46 are mounted in an L-shaped passage of single length bearings 50, 50; and the inner stub shafts 48, 48 are both mounted in opposite ends of L-shaped passages of a double length T-shaped bearing 52. Each passage has a horizontally-extending cutout passage portion through which the respective stub shaft is inserted. The cutout portion has an opening which is sized such that the stub shaft can fit therethrough with clearance. Each passage also has a vertically-extending journal passage portion which communicates with the cutout portion. The journal portion receives the respective stub shaft and journals the latter in the journal portion. As will be described below, each stub shaft is maintained in its respective journal passage portion by spring tension.

The journalled shafts permit each cover to be moved between a closed position, as illustrated by the cover on the left side of FIGS. 1 and 2, and an open position, as illustrated by the cover on the right side of FIGS. 1 and 2. In the fully closed or non-use position, the cover horizontally overlies the plane of the opening 26 and bars insertion of the plug prongs into the sockets. In the fully open or in-use position, to cover extends generally vertically and substantially normally of the plane of the opening 26 to thereby grant free access for the prongs to the sockets.

The gasket 44 constitutes waterproofing means which moves together with the cover. In the fully closed position, the gasket 44 sealingly and watertightly engages the wall portions 24*a*, 24*b*, 24*c*, 24*d*. The gasket is compressed between the rims 40, 42 and the wall portions 24*a*, 24*b*, 24*c*, 24*d*, and this compression prevents water from reaching the sockets. The sockets are thereby safely protected from corrosion.

Figure 4:
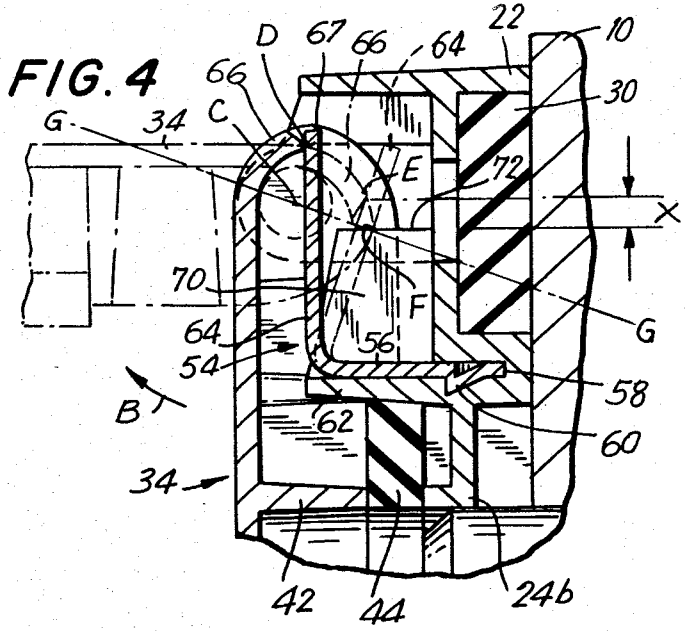
FIG. 4 is an enlarged detail of FIG. 3 and shows the protective cover in its fully open and its fully closed positions.

As best seen in FIGS. 3 and 4, an energy-storing metal leaf spring or biasing means 54 is disposed intermediate and in force-transmitting engagement with both the plate and the cover. The leaf spring 54 has a generally planar captivated portion 56 which is received in a vertical recess 58 of the plate. A barbed portion 60 is stamped out and offset at an inclined angle relative to the plane of the captivated portion 56. Upon insertion into the recess 58, the barbed portion 60 wedges into the recess 58 and actually bites into the vertical wall 62 of the plate to thereby be staked into the latter and effectively prevent the captivated portion from undesirably disengaging from the recess 58.

The leaf spring also has a generally planar, tensionable, cantilever free end portion 64 which is in force-transmitting engagement with the rear or leading end 66 of the cover, i.e. the end which is furthest from the tip 38, at a contact zone. The free end portion 64 is movable from a generally horizontal solid line position in FIG. 4 to a deflected or flexed position as shown in phantom lines in FIG. 4. In the horizontal position, the spring is not relaxed, but is tensioned to thereby constantly and affirmatively maintain the cover in its aforementioned closed position with a closure force of a predetermined magnitude. In the deflected position, the spring is more highly tensioned to thereby constantly and affirmatively urge the cover from its open position to its closed position with a closure force having a magnitude which is greater than said predetermined magnitude. This automatic closing of the cover protects the sockets after the prongs have been removed from the latter.

Anti-over-the-center stop means are provided in order to ensure a reliable and automatic return of the cover from its fully open to its fully closed position under the influence of the greater magnitude closure force. For each outlet to be protected, the stop means includes a pair of projections or stops 70 of one piece with the plate and being located on opposite lateral sides of the leaf spring 54. Each stop 70 has an abutment contact surface 72 at which the leading cover end 66 abuts at the abutment zone F.

As best shown in FIG. 4, the planar tensionable free end portion 64 contacts the cover at contact zone D when the cover is in the fully closed position. The contact zone is essentially a line contact, but can also be a surface or point contact. As shown, the contact zone D is adjacent the tip 67 of the spring.

As the cover is raised to its fully open position, the contact zone moves lengthwise along the elongated free end portion 64. Put another way, the contact zone moves inwardly away from the spring tip 67. When the cover is in the fully open position, the contact zone is identified by the letter E. Again, this is shown as a line contact, but it can also be a point or surface contact.

Each abutment surface 72 is located in the respective circular path B such that the cover is prevented from moving past its fully open position. Concomitantly, the contact zone E is so positioned relative to the spring such that a restoring torque is always exerted by the spring on the cover. More particularly, the contact zone E is always spaced upstream of an imaginary line G-G which extends from the center of curvature C of the respective circular path both in a radial direction towards, and at a right angle to, the plane of the planar free end portion 64.

Imaginary line G-G extends through the abutment zone F, i.e. where the leading cover end 66 engages the abutment surface 72. Although the leading cover end 66, as illustrated, does not extend beyond the imaginary line G-G, this is not essential to the invention. The critical factor is that the contact zone E be spaced either at, or at an upstream location of the respective circular path away from, the imaginary line G-G. The distance x illustrates the spacing of the contact zone E from the abutment zone F in the horizontal direction.

It will be noted that if the contact zone E crossed and extended beyond the imaginary line G-G, then the cover would tilt backwardly and define an obtuse angle relative to the plane of the opening 26. If this occurred, the leaf spring would no longer urge the cover back to its original fully closed position. In fact, the spring would now urge the cover to tilt even further backwards.

The leading cover end 66 is formed with a shallow notch 80 for receiving the free spring end 64. The depth of this notch 80 accounts for the spacing between the contact zone E and the abutment zone F. If the notch 80 were not present, then contact zone E would coincide with abutment zone F.

The notch 80 has shoulders or side wall portions 82, 84 at opposite lateral sides of the notch. The side wall portions serve to prevent undesired lateral displacement of the spring relative to the cover. This is a very desirable feature because the leaf spring is kept in its proper place during handling, shipping, installation and use.

The cover moves through an infinite number of intermediate positions between the illustrated fully open and fully closed positions. The electrical plug can be inserted into its associated outlet in any one of these intermediate positions as soon as the cover is sufficiently removed from the opening such that no mechanical interference exists between the plug and the cover. The planar portion 64 progressively releases energy as it moves successively through these intermediate positions to its fully closed position. Even in the fully closed position, the planar portion 64 still exerts a restoring force on the cover.

The spring also serves to lock the respective stub shafts in their associated bearings. The restoring force which is always exerted on the leading end of the cover is simultaneously exerted on the stub shafts which are of one-piece with the cover. The restoring force has a vertical component of motion which biases the respective stub shaft against the upper inner circumferential surface of the associated journal portion. The stub shafts therefore are inserted through the cutout section of the passage and are thereupon urged upwardly into the journal portion by spring tension. The shafts do not disengage from the bearings during operation.

Another aspect of the bearings is that each passage does not extend entirely through the associated bearing. This means that the outer end walls of the bearings are solid walls which, of course, do not permit water to pass therethrough.

BEST AVAILABLE COPY

Referring now to the embodiment of FIGS. 6–12 of the drawings, primed reference numerals have been used to identify the component parts of this embodiment which are substantially similar to the earlier-described unprimed reference numerals of the embodiment of FIGS. 1–5. Due to the similarity of structure and function between these corresponding parts, a reiteration of the above description is not believed to be necessary, and hence, has not been provided for the sake of brevity.

The essential difference between the embodiment of FIGS. 1–5 and FIGS. 6–12 lies in the energy-storing spring and the manner in which it interacts with the cover and the plate. The biasing means or energy-storing leaf spring 54′ in the embodiment of FIGS. 6–12, like the aforementioned leaf spring 54, is disposed intermediate, and in force-transmitting engagement with, both the plate 22′ and the cover 34′. The leaf spring 54′ has a generally planar captivated portion 56′ and a generally planar, tensionable, cantilever free end portion 64′.

Figures 6, 8:
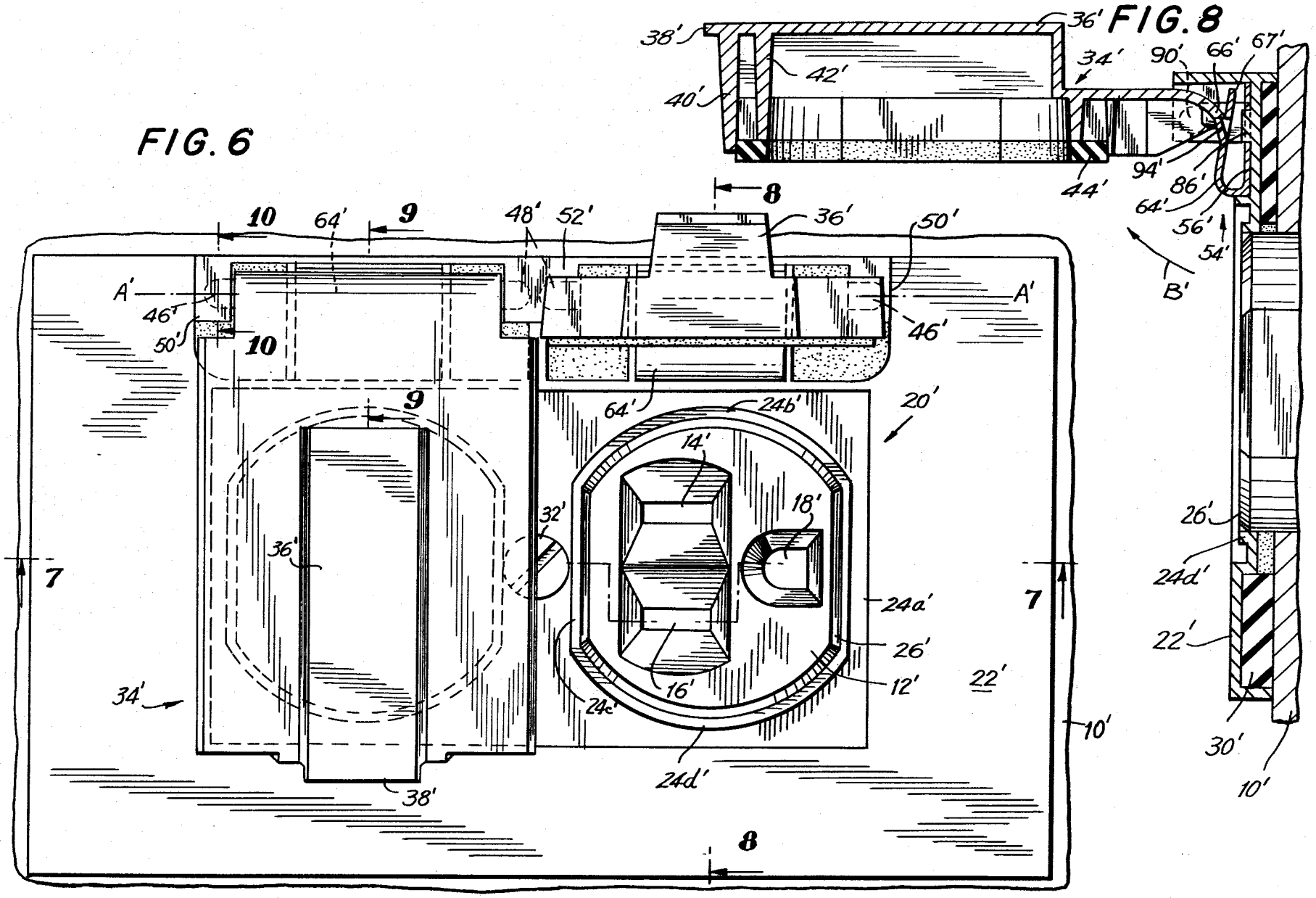
FIG. 6 is a top plan view analogous to FIG. 1 of another embodiment in accordance with this invention.
FIG. 8 is a cross-sectional view as taken along line 8—8 of FIG. 6.

As best shown in FIGS. 8 and 9, the captivated portion 56′ is formed with a circular aperture which receives a raised circular projection 86′ that is formed of one-piece with the plate 22′. The captivated portion 56′ is preferably detachably mounted on the projection 86′, i.e. the projection 86′ is not swaged over or otherwise deformed, in order to facilitate the assembly by the manufacturer or by the electrician.

As best shown in FIGS. 8, 9 and 12, the cantilever portion 64′ engages the rear or leading end 66′ of the cover, i.e. the end which is furthest from the tip 38′. The cantilever portion 64′ is movable from a generally horizontal position shown in FIG. 9 to a deflected or flexed position shown in FIG. 8. In the horizontal position, the cantilever portion 64′ is not relaxed, but is tensioned to thereby constantly and affirmatively maintain the cover in its closed position with a closure force of a predetermined magnitude. In the deflected position, the spring is more highly tensioned to thereby constantly and affirmatively urge the cover from its open to its closed position with a closure force having a magnitude which is greater than said predetermined magnitude. This automatic closing of the cover protects the sockets after the prongs have been removed from the latter.

As best shown in FIG. 12, the rear end 66′ of the cover 34′ does not make a line contact with the cantilever portion 64′, as is the case for the embodiment of FIGS. 1–5, but instead a two-point rolling contact is established. A pair of semi-spherical, generally dome-shaped contact portions 90′, 92′ are formed of one-piece with the cover 34′ at the rear end 66′ thereof and are spaced apart of each other by a distance less than the width of the cantilever portion 64′. The two-point rolling contact provides more uniform pressure on the cantilever portion 64′, less friction due to the lower coefficient of rolling friction, smoother action in opening the cover, and less wear on the rear end of the cover.

Anti-over-the-counter stop means are provided in order to insure a reliable and automatic return of the cover from its fully open to its fully closed position under the influence of the greater magnitude closure force. The stop means includes a stop 94′ of one-piece with the cantilever portion. The stop 94′ is stamped out and offset from the plane of the cantilever portion 64′. An abutment 96′ at the rear end 66′ of the cover 34′ abuts against the stop 94′, and thereby defines the fully-open position.

As the cover is raised to its fully open position, the contact portions 90′,92′ roll along and move lengthwise along the cantilever portion 64′ until the abutment 96′ engages the stop 94′. A restoring force is always exerted by the leaf spring on the cover.

Turning now to FIGS. 10 and 11, each stub shaft 46′ is mounted in an L-shaped passage formed within bearing 50′. The cantilever portion 64′ also serves to lock the stub shafts in their respective bearings. The stub shafts do not disengage from their bearings during opening and closing of the cover.

It will be understood that each of the elements described above, or two or more together, may also find a useful application in other types of constructions differing from the types described above.

While the invention has been illustrated and described as embodied in a weather-resistant arrangement for outdoor electrical outlets, it is not intended to be limited to the details shown, since various modifications and structural changes may be made without departing in any way from the spirit of the present invention.

Without further analysis, the foregoing will so fully reveal the gist of the present invention, that others can, by applying current knowledge, readily adapt it for various applications without omitting features that, from the standpoint of prior art, fairly constitute essential characteristics of the generic or specific aspects of this invention and, therefore, such adaptations should, and are intended to, be comprehended within the meaning and range of equivalence of the following claims:

What is claimed as new and desired to be protected by Letters Patent is set forth in the appended claims:

1. A weather-resistant arrangement for protecting an outdoor electrical receptacle having an electrical device thereon from the deleterious effects of weather conditions, such as moisture, snow, rain, and like environmental conditions, comprising:

(a) a receptacle plate for mounting in sealing engagement with an outdoor support structure on which the receptacle to be protected is supported, (i) said plate having wall portions bounding an opening at which the device is located, and through which access to the device is established;

(b) a protective cover pivotally mounted on said plate for turning movement about a turning axis and along a generally circular path, said cover being manually movable from an end-limiting fully closed position, in which said cover overlies said opening and bars access to the device, to an end-limiting fully open position, in which said cover extends at an angle relative to the plane of said opening and permits access to the device;

(c) waterproofing means mounted on said cover for movement together with the same, (i) said waterproofing means sealingly and watertightly engaging said wall portions of said plate in said closed position to thereby prevent water from reaching the device and doing damage; and (d) means for constantly and affirmatively urging said cover in all positions of the latter along said path towards said closed position to thereby automatically protect the device during non-use of the same, said urging means including (i) biasing means in force-transmitting engagement with said plate and said cover, said biasing means constituting an energy-storing leaf spring having a captivated portion mounted on said plate, and a planar cantilever portion engaging said cover at a mutual contact zone, said cantilever portion being movable along said circular path between a first tensioned position, in which said cover is affirmatively maintained at said closed position thereof with a closure force of a predetermined magnitude, and a second tensioned position, in which said cover is affirmatively urged from said open to said closed position thereof with a closure force of a magnitude greater than said predetermined magnitude, said leaf spring constantly exerting a restoring force on said cover in all positions thereof, including the fully open position, for automatically returning said cover, upon manual release of the same in said fully open position, from said fully open to said fully closed position without mechanical interference and without manual assistance, and (ii) anti-over-the-center stop means in said path for preventing movement of said cover past said fully open position, and for concomitantly preventing said contact zone from being so positioned relative to said spring such that a restoring torque is constantly exerted by said spring on said cover, said stop means constituting a stop located in said circular path such that said contact zone is located substantially at or spaced upstream of an imaginary line which extends from the center of curvature of said circular path both in a radial direction towards, and at a right angle to, the plane of said planar cantilever portion, to thereby reliably and automatically return said cover to said closed position thereof.

2. The weather-resistant arrangement as defined in claim 1, wherein said cover has a raised rim, and wherein said waterproofing means is adhesively mounted on said rim.

3. The weather-resistant arrangement as defined in claim 1, wherein said cover has a handle portion for facilitating manual gripping by a user.

4. The weather-resistant arrangement as defined in claim 1; and further comprising an offset barbed portion on said captivated portion, said barbed portion penetrating and biting into said plate for locking said captivated portion in a fixed position relative to said plate.

5. The weather-resistant arrangement as defined in claim 1, wherein said cover has a leading end region which is movable along said path, and wherein said leading end region has a pair of side walls which bound a notch in which said cantilever portion is received, said side walls being operative for preventing undesired lateral displacement of said cantilever portion relative to said leading end region of said cover.

6. The weather-resistant arrangement as defined in claim 1, wherein said stop includes a pair of projections, each being of one piece with said plate and being located at opposite sides of said biasing means.

7. The weather-resistant arrangement as defined in claim 1, wherein said plate has auxiliary wall portions which bound an additional opening at which additional sockets are located; and wherein said first-mentioned cover, waterproofing means, biasing means and anti-over-the-center stop means together constitute a unit; and further comprising an additional unit at said additional opening for protecting said additional sockets.

8. The weather-resistant arrangement as defined in claim 1, wherein the device is an electrical outlet having a plurality of female-type sockets each operative for receiving mating male-type prongs of an electrical plug, and wherein said cover bars and permits insertion of the prongs into the sockets in said closed and open positions, respectively.

9. The weather-resistant arrangement as defined in claim 1, wherein said planar cantilever portion is movable between said tensioned positions, and wherein said contact zone is movable lengthwise of said planar portion during said pivoting movement of said cover.

10. The weather-resistant arrangement as defined in claim 9, wherein said cover has a leading end region movable along said circumferential path, and wherein said stop has an abutment surface for engagement with said leading end region such that the latter does not extend beyond the imaginary line.

11. The weather-resistant arrangement as defined in claim 1; and further comprising a pair of journal bearings each being of one-piece with said plate; and a pair of stub shafts on opposite lateral sides of, and of one piece with, said cover, each stub shaft being journalled in a bearing.

12. The weather-resistant arrangement as defined in claim 11, wherein each bearing has wall portions defining an L-shaped passage for receiving the respective shaft, and wherein each passage has a cutout section through which the respective shaft is inserted with clearance in direction radially of said turning axis, and a journal section in communication with said cutout section and operative for receiving the respective shaft after insertion into said cutout section in response to movement of said biasing means.

13. The weather-resistant arrangement as defined in claim 1, wherein said cover has a leading end region which is movable along said path, and a pair of spaced-apart generally domeshaped contact portions rollingly engaging said cantilever portion at respective points of contact throughout said movement.

14. The weather-resistant arrangement as defined in claim 13, wherein said stop on said cantilever portion, said stop abuttingly engaging said leading end region of said cover to define said fully open position.

* * * * *